US010113324B2

(12) United States Patent
Taylor

(10) Patent No.: US 10,113,324 B2
(45) Date of Patent: Oct. 30, 2018

(54) RE-POSITIONABLE FLOOR GUIDE SYSTEM AND TOOL FOR USE IN THE SAME

(71) Applicant: ISCHEBECK TITAN LIMITED, Burton upon Trent, Staffordshire (GB)

(72) Inventor: Mark Taylor, Burton upon Trent (GB)

(73) Assignee: ISCHEBECK TITAN LIMITED, Burton upon Trent (GB)

( * ) Notice: Subject to any disclaimer, the term of this patent is extended or adjusted under 35 U.S.C. 154(b) by 0 days.

(21) Appl. No.: 15/218,661

(22) Filed: Jul. 25, 2016

(65) Prior Publication Data

US 2017/0030094 A1 Feb. 2, 2017

(30) Foreign Application Priority Data

Jul. 30, 2015 (GB) ..... 1513451.3

(51) Int. Cl.
*E04G 21/32* (2006.01)

(52) U.S. Cl.
CPC ..... *E04G 21/3223* (2013.01); *E04G 21/32* (2013.01)

(58) Field of Classification Search
CPC . E04G 21/3223; E04G 21/32; E04G 21/3204; E04G 3/28; E04G 11/20; E06C 7/186; E06C 7/18; A62B 35/0093
USPC ..... 182/3, 36
See application file for complete search history.

(56) References Cited

U.S. PATENT DOCUMENTS

| | | | | | |
|---|---|---|---|---|---|
| 5,029,670 | A * | 7/1991 | Whitmer | A62B 35/0056 | 182/113 |
| 5,092,426 | A * | 3/1992 | Rhodes | A62B 35/0068 | 182/3 |
| 5,529,144 | A * | 6/1996 | Henderson | A62B 35/0056 | 182/3 |
| 5,711,397 | A * | 1/1998 | Flora | A62B 35/0062 | 182/3 |
| 5,857,651 | A * | 1/1999 | Kunevicius | F41B 5/14 | 248/218.4 |
| 6,173,809 | B1 * | 1/2001 | Cole | E04G 21/3261 | 182/3 |
| 8,646,575 | B1 * | 2/2014 | Guthrie | A62B 35/0068 | 182/3 |
| 2006/0272889 | A1 * | 12/2006 | Paquette | A62B 1/04 | 182/3 |

(Continued)

FOREIGN PATENT DOCUMENTS

| | | | |
|---|---|---|---|
| CN | 202164809 | U | 7/2011 |
| EP | 0018014 | A2 | 10/1980 |

(Continued)

*Primary Examiner* — Muhammad Ijaz
(74) *Attorney, Agent, or Firm* — Andrew W. Chu; Craft Chu PLLC

(57) ABSTRACT

The tool re-positions a floor guide supporting a climbing screen. The climbing screen includes a mounting arm that extends along a longitudinal axis and is fixed to a floor of a construction. The tool includes a first member fixable to the floor of the construction at a first position along the axial length of the mounting arm, a second member fixable to the mounting arm at a second position spaced along the longitudinal axis of the mounting arm from the first member, and a driver linking the first and second members to one another and operable for varying the spacing between the first and second members along the longitudinal axis.

13 Claims, 3 Drawing Sheets

(56) References Cited

U.S. PATENT DOCUMENTS

| | | | | |
|---|---|---|---|---|
| 2011/0214388 | A1* | 9/2011 | London | E04G 21/32 52/745.21 |
| 2014/0182236 | A1* | 7/2014 | Doupe | E04B 1/38 52/705 |
| 2014/0224579 | A1* | 8/2014 | Balascak | E04G 21/328 182/3 |
| 2015/0157885 | A1* | 6/2015 | Liu | E04G 21/32 182/3 |
| 2015/0217148 | A1* | 8/2015 | Eltringham | A62B 35/0068 182/36 |
| 2016/0356050 | A1* | 12/2016 | Tsaousis | E04G 21/3242 |
| 2017/0030094 | A1* | 2/2017 | Taylor | E04G 21/3223 |

FOREIGN PATENT DOCUMENTS

| | | | |
|---|---|---|---|
| EP | 2503077 | A1 | 3/2011 |
| EP | 2789772 | A1 | 4/2013 |
| GB | 2482314 | A | 2/2012 |
| WO | 2011007949 | A1 | 1/2011 |

* cited by examiner

RE-POSITIONABLE FLOOR GUIDE SYSTEM AND TOOL FOR USE IN THE SAME

CROSS-REFERENCE TO RELATED APPLICATIONS

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present disclosure relates to a floor guide system, to a method for re-positioning a floor guide and to a tool for the same.

2. Description of Related Art Including Information Disclosed Under 37 CFR 1.97 and 37 CFR 1.98

In modern construction, particularly in the construction of high rise buildings it is common to have a central core, which houses lift shafts and stair wells and which provides support to the floors of the construction, wherein the central core and floors are formed by poured concrete. Such structures commonly have no external walls. During large periods of construction therefore, the floors remain open at their edges. It is only when a façade is introduced that the perimeter of the building is enclosed. Such open floors cause numerous health and safety risks. Workers operating on the exposed floors of the construction are at risk of falling from the construction. Workers or members of the public on the ground are at risk from tools, equipment or debris falling from the exposed floors.

It is known to provide safety screens, which extend around at least a portion of the perimeter of constructions, which effectively provide a temporary façade, and advantageously provide safe working platforms spaced outwardly from the floors. These safety screens are advantageously moveable vertically to protect the perimeter of any required floor as the construction progresses. Such screens are commonly referred to as "climbing screens". Movement of the climbing screens up the construction may be effected either by crane or by hydraulic lifting equipment located on floors of the construction.

These climbing screens typically comprise a climbing rail and a safety screen. The climbing rail is engaged, in use, by floor guides, which project outwardly from the edges of the floors. The floor guides allow translation of the climbing screen along the construction and are further operable to lock the position of the climbing screen adjacent appropriate floors during use.

The floor guides are fixed to the floors of the construction using anchor bolts or similar and climbing shoes are attached to the ends of the floor guides for supporting the climbing screen. Generally, the anchor bolts are cast into the floors of the construction during formation. Problems of misalignment can occur due to the tolerances and differences between floors. Prior art solutions to problems of misalignment have been proposed and include floor guides that allow for adjustment, such as disclosed in GB 2482314.

Whilst such adjustable floor guides are effective for overcoming problems of misalignment, they are bulky, heavy and costly. There would be clear benefit in a means of offering adjustment to lower cost more conventional floor guides.

BRIEF SUMMARY OF THE INVENTION

According to the present invention in a first aspect, there is provided a floor guide system as recited by Claim 1.

According to the present invention in a further aspect, there is provided a method of re-positioning a floor guide using a floor guide system as defined above comprising: fixing the first member to the floor using the tool fixing means, fixing the second member to the mounting arm, releasing the floor guide fixing means fixing the mounting arm to the floor, and operating the driving means to slide the mounting arm across the floor along its longitudinal axis.

According to the present invention in a yet further aspect, there is provided a tool for re-positioning a floor guide, comprising: a first member fixable, in use, to the floor of the construction at a first position along an axial length of a mounting arm of the floor guide by a tool fixing means, a second member fixable, in use, to the mounting arm at a second position spaced along the longitudinal axis of the mounting arm from the first member, and a driving means linking the first and second members to one another and operable for varying the spacing between the first and second members along the longitudinal axis, wherein, in use, the first member extends over and straddles the mounting arm.

Further, preferred, features are presented in the dependent claims.

BRIEF DESCRIPTION OF THE SEVERAL VIEWS OF THE DRAWINGS

Non-limiting embodiments will now be described, by way of example only, with reference to the accompanying drawings.

DETAILED DESCRIPTION OF THE INVENTION

Figure 1:
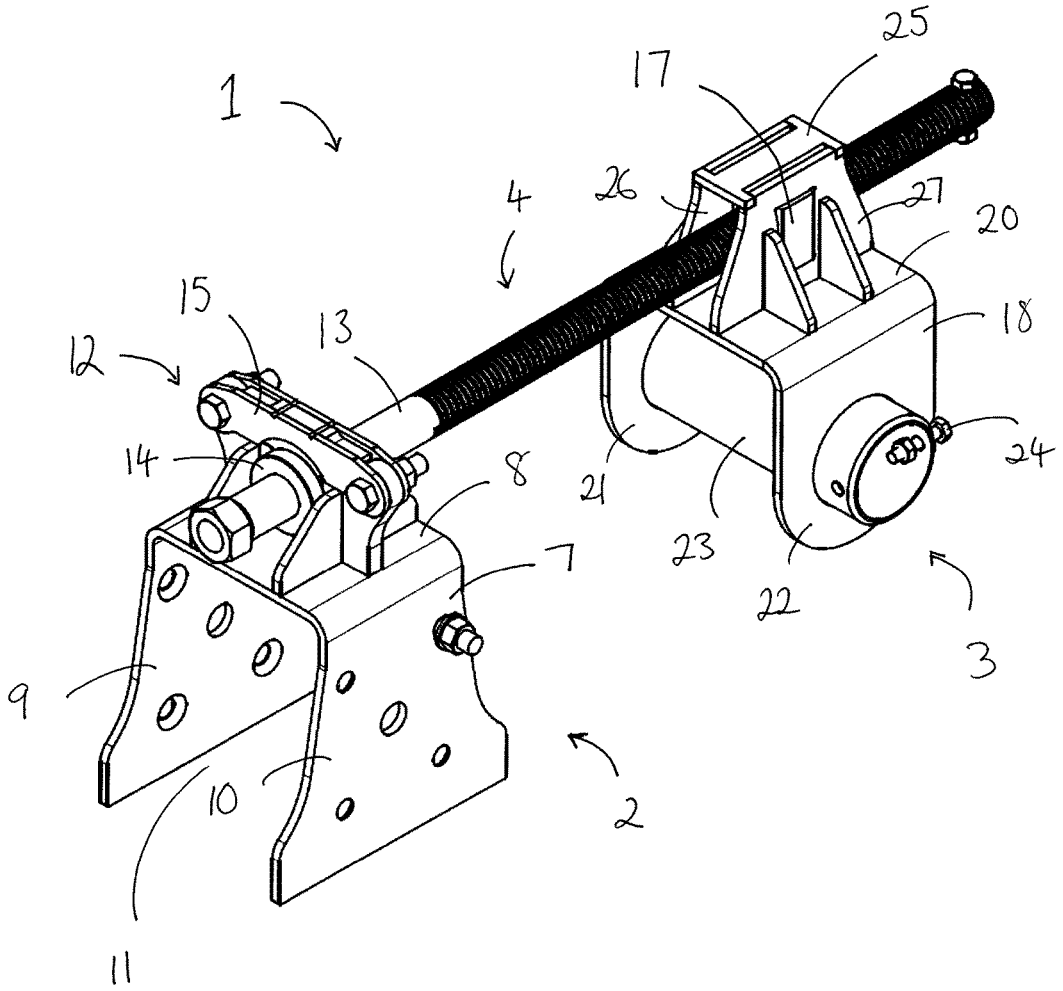
FIG. 1 shows a perspective view of a tool according to an embodiment of the present invention.

FIGS. 1 to 4 The tool 1, as seen most clearly in FIG. 1, broadly comprises a first member 2, which is fixable to the floor of a construction at a first position along the axial length of a mounting arm 5 by a tool fixing means; a second member 3, which is fixable to the mounting arm 5 at a second position spaced along the longitudinal axis of the mounting arm from the first member 2; and a driving means 4, which links the first and second members 2, 3 to one another and is operable for varying the spacing between the first and second members along the longitudinal axis.

By such an arrangement, when the first member is fixed to the floor of the construction, a floor guide fixing means that fixes the floor guide to the floor of the construction is released and the driving means is operated, variation in the spacing between the first and second members 2, 3 will translate into a sliding of the mounting arm 5 (and thereby the floor guide as a whole) across the floor of construction along the longitudinal axis. Once a suitable position has been reached, the floor guide may be fixed back to the floor of the construction and the tool may be removed.

Figure 2:
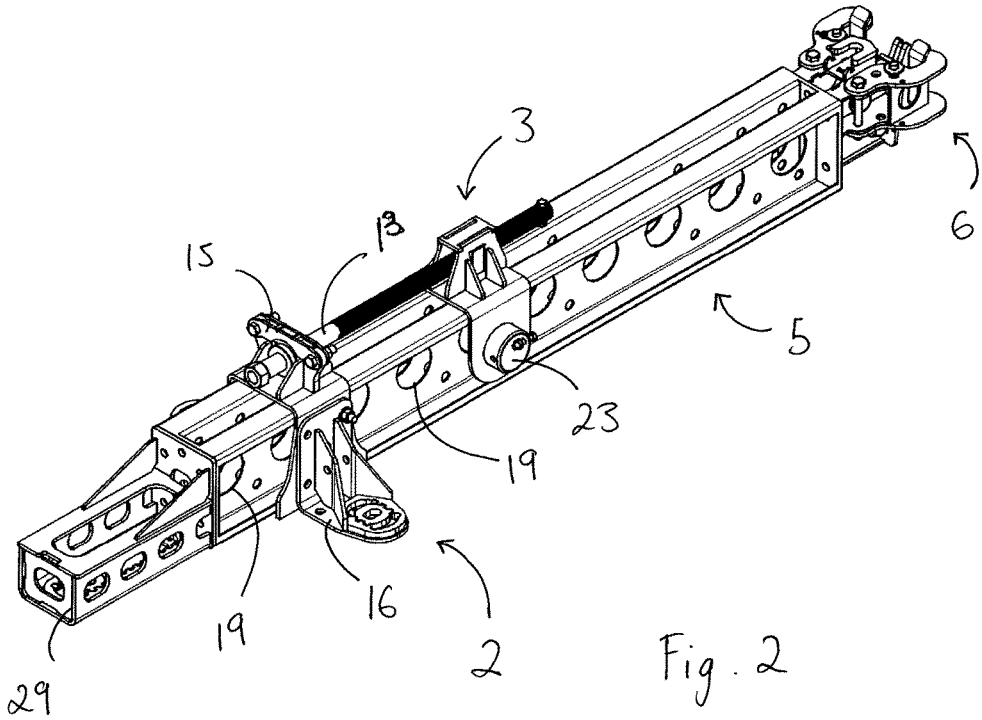
FIG. 2 shows a perspective view of the tool of FIG. 1 attached to a floor guide.
Figure 3:
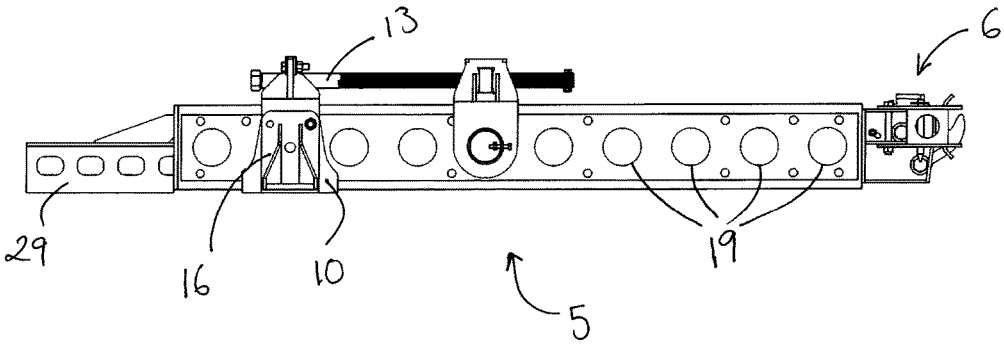
FIG. 3 shows a side view of the arrangement of FIG. 2.
Figure 4:
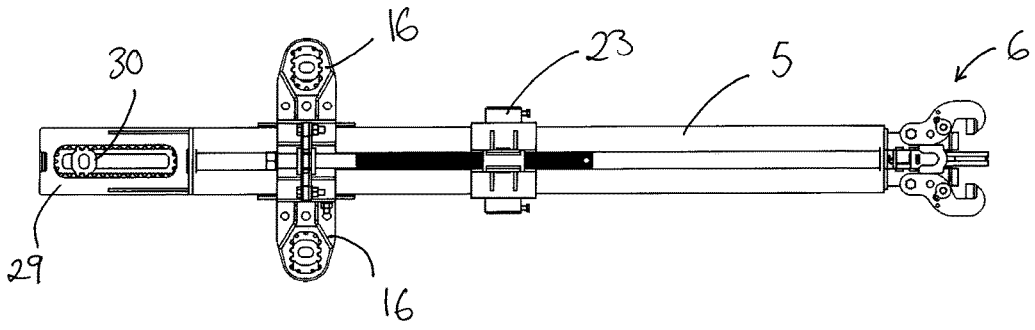
FIG. 4 shows a top view of the arrangement of FIG. 2.
Figure 5:
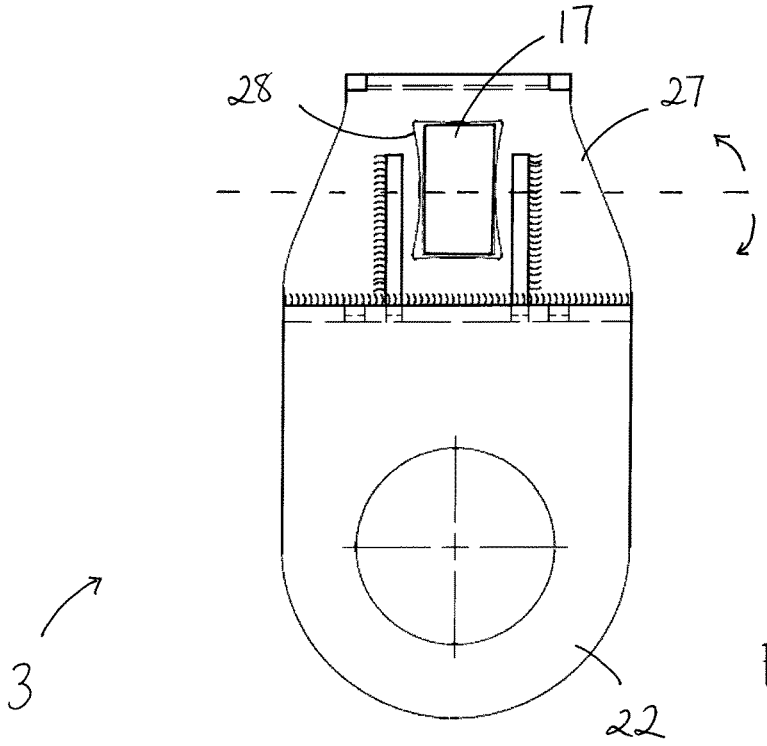
FIG. 5 shows a detailed partial side view of a second member of the tool of FIG. 1.

The floor guide may be of standard construction, in particular the mounting arm 5 may be of I-beam construction or may comprise a pair of back to back C-channels, as seen by way of example in FIGS. 2 to 4. A climbing shoe 6 will be mounted at its end to project outwardly beyond a peripheral edge of the floor, in use, for supporting the climbing rail of a structure to be supported by the floor guide. Such supported structure may comprise any of a climbing screen, climbing formwork, hoist or otherwise, as will be readily appreciated by those skilled in the art.

Whilst the tool described in detail below takes a specific form, it should be appreciated that numerous modifications will be possible within the scope of the claims. In particular, whilst the driving means comprises a screw drive means, it may comprise a hydraulic arrangement, or otherwise.

It is preferred that the first member 2 extends at least partially over the mounting arm 5 when it is fixed to the floor of the construction for substantially preventing uplift of the mounting arm from the floor. In the disclosed arrangement, as may be seen in FIGS. 2 to 4, the first member 2 straddles (or bridges) the mounting arm, wherein it thereby substantially prevents both uplift of the mounting arm 5 from the floor and transverse movement of the mounting arm 5. In such arrangement, the first member 2 is fixable to the floor of the construction on opposed sides of the longitudinal axis of the mounting arm. The first member may be considered to define an opening 11 through which the mounting arm 5 extends in use. The opening 11 preferably closely conforms to the outer profile (outermost edges) of the mounting arm.

The first member 2 of the present arrangement may be considered to comprise a U-shaped bracket 7 (of upturned form). It preferably has a substantially square profile, defining a substantially horizontal planar upper portion 8 having a width that is greater than the width of the mounting arm 5 it spans; and a pair of vertical leg portions 9, 10 projecting downwards from the edges of the upper portion 8 on either side of the mounting arm 5, which legs 9, 10 are substantially planar. Here, the U-shaped bracket 7 defines the opening 11 with abutment of the upper face of the mounting arm with the upper portion 8 preventing uplift and abutment of side edges of the mounting arm with the leg portions 9, 10 preventing transverse movement. The U-shaped bracket may be unitarily formed by bending a plate. The lower region of each of the legs may be considered to define a foot for engaging the floor of the construction. As may be seen the lower regions are flared outwardly, such that they have a greater dimension in the longitudinal direction to resist twisting loads.

On the upper portion 8 of the first member 2, there is provided a mounting bracket 12 for a receiving and retaining a first end of a threaded drive rod 13 of the screw drive means. The bracket 12 is preferably arranged to hold captive a bearing 14 that is arranged to allow for rotation of the drive rod 13. Any suitable rotation means may be provided for, such as a nut as shown. The bracket 12 may take any suitable form, as will be appreciated by those skilled in the art. In the present arrangement, the bracket 12 may be opened to allow (attachment or) detachment of the driving means (and thereby the second member 3) when the tool is in use, or otherwise. For such purposes, in the present arrangement, a closure element 15 is provided. The closure element is bolted at its opposed ends. By virtue of this arrangement it may act as a lockable pivotal flap by release at one end only. It should be noted that whilst in the present arrangement, the first member 2 is provided with the mounting bracket 12, in alternative arrangements this could instead be provided on the second member 3, with the presently described screw drive means provided in reverse to the present arrangement (i.e. rotated through 180 degrees).

The first member 2 is arranged to be fixed to the floor, as discussed. In the present arrangement, suitable fixing brackets 16 are provided, which, as seen in FIGS. 2 and 4, may be provided. Such brackets may take any suitable form. Here they comprise right-angle brackets that are bolted to the legs and floor using suitable fixing means.

The driving means 4 preferably provides a rigid interconnection between the first and second members. As discussed, in the present arrangement, the driving means comprises the threaded drive rod that is supported at its first end by the bearing 14 held captive by the bracket 12. The bearing engages a non-threaded portion of the drive rod 13. The threaded portion of the drive rod 13 engages a floating nut 17. The floating nut 17 is supported by the second member 3. The drive rod 13 is parallel to an in vertical alignment with a longitudinal centerline of the mounting arm 5. The drive rod 13 lies above the longitudinal centerline of the mounting arm 5.

The form of the second member 3 will be dependent on the mounting arm 5 that it is to be attached to. Numerous suitable arrangements will be readily envisaged by those skilled in the art. A preferred arrangement is described herein that is suitable for attachment to an exemplary mounting arm 5 that comprises a plurality of through holes 19 that are spaced from one another along the length of the mounting arm 5 with their axes perpendicular to the longitudinal axis thereof. The second member 3 of the present arrangement may also be considered to comprise a U-shaped bracket 18 (of upturned form). It preferably has a substantially square profile, defining a substantially horizontal planar upper portion 20 having a width that is greater than the width of the mounting arm 5 it spans; and a pair of vertical arm portions 21, 22 projecting downwards from the edges of the upper portion 20 on either side of the mounting arm 5, which arms 21, 22 are substantially planar. The arms 21, 22 are provided with co-axial through holes that may be brought into alignment with any of the through holes 19 provided along the mounting arm 5. A locking member 23 is provided, which is received through the aligned through holes to lock the second member 3 to the mounting arm 5 at a position spaced along the longitudinal axis from the first member 2. Here the locking member is tubular with an outer diameter conforming closely to the inner diameter of the openings 19 Suitable means are provided for restricting axial movement of the locking member 23. In the present arrangement bolts 24 are provided.

On the upper portion 20 of the second member 3, there is provided a mounting bracket 25 for holding the floating nut 17 captive. The floating nut is in the form of a rectangular parallelepiped that is provided with a threaded through hole. The bracket 25 comprises pair of vertical plates 26, 27 that are parallel with the longitudinal axis and are provided with aligned openings 27 for receiving the floating nut 17. The openings 27 as seen most clearly in FIG. 4 are shaped to allow for pivotal movement of the nut 17 back and forth in the direction of the longitudinal axis with curved vertical walls. The openings 27 may be configured to allow for a pivot from the vertical, back or forth, by less than 10 degrees, more preferably by 5 degrees or less. As with the second member 3 more generally, the bracket and the threaded member engaging the threaded rod may take numerous alternative forms, as will be appreciated by those skilled in the art.

A method of re-positioning a floor guide using the tool of the present invention may comprise fixing the first member 2 to the floor of the construction with the tool fixing means (with the first member straddling the mounting arm); fixing the second member 3 to the mounting arm 5 and the driving means 4 to the first member 2; releasing the floor guide fixing means fixing the mounting arm 5 to the floor; and operating the driving means 4 to slide the mounting arm 5 across the floor along its longitudinal axis. Such action may occur whilst the floor guide is supporting the climbing rail of a supported structure (climbing screen, or similar).

Following such movement, the mounting arm 5 may be fixed back to the floor using a new floor guide fixing means in a different position, which fixing means may comprise a drilled anchor bolt at the required new position; and the tool may be removed.

Alternatively, the tool could remain in place acting as a replacement fixing means. In particular, the tool could be used to re-position a floor guide and to fix that floor guide to the floor in a new position for as long as it supports the climbing rail of a supported structure (climbing screen, or similar). In this case the tool may be removed at the time of removing the floor guide from the construction.

It should be appreciated that the tool of the present arrangement is of particular use in situations where a floor guide is fixed in the wrong position and must be re-positioned. This includes floor guides, where the mounting arm is fixed to the floor of the construction using a conventional (non-adjustable fixing means), which may comprise a fixing bracket that is attached to a cast or drilled floor anchor with a suitable bolt. The tool may, however, find application as part of an adjustable floor guide system, where the fixing means for fixing the mounting arm 5 to the floor of the construction allows for re-positioning.

The non-limiting arrangement of FIGS. 2 to 4 shows an adjustable floor guide system. In this arrangement, the fixing means comprises a bracket 29 for mounting to the floor of a construction. The bracket 29 is arranged to be fixed to the floor using an anchor means, which comprises an anchor bolt, which may be cast into the floor of the construction such that its position is fixed. The bracket is bolted to the mounting arm. The bracket is arranged to be fixed to the anchor bolt in a range of positions to compensate for misalignment of the anchor bolt and/or tolerances elsewhere. The bracket 29 comprises a first opening arranged to receive a washer 30. The washer 30 comprises a second opening arranged to receive the anchor bolt. The washer is clamped to the bracket 29 using a nut. The washer comprises a plurality of lugs and the bracket comprises a plurality of indents. The first opening extends along the longitudinal axis and comprises first and second sides that extend substantially parallel to the longitudinal axis, and along each side of the first opening there is provided a plurality of the indents, which are spaced from one another at a predetermined pitch in the direction of the longitudinal axis, and the washer 30 comprises first and second sides that extend substantially parallel to one another, and on each side of the first and second sides of the washer 30 there is provided one or more of the lugs, each of which is engageable with a respective one of the indents provided along a corresponding one of the first and second sides of the opening in the bracket 29, whereby engagement of the lugs and indents prevents movement of the first part relative to the second part in the direction of the first longitudinal axis. The fixing means may be adjusted by moving the bracket 29 relative to the washer in the direction of the longitudinal axis. The washer 30 may then be seated at the appropriate position with each of the lugs engaging a corresponding indent at that position.

As may be seen in FIGS. 2 and 4, a corresponding adjustment means for appropriately aligning the fixing brackets 16 in the transverse direction may be provided, which despite different orientation and form will be identical to the fixing means described above, the description of which is directly applicable to the adjustment means for the fixing brackets 16. It should be appreciated that such an adjustment means for the fixing brackets 16 may be provided in combination with or separately to the adjustable fixing means for the mounting arm mentioned above. Moreover, alternative arrangements may use a conventional (non-adjustable fixing) for fixing the fixing brackets 16 to the floor of the construction whether the above adjustable fixing means for the mounting arm is used or not.

I claim:

1. A floor guide system, comprising:

a floor guide, comprising a mounting arm extending along a longitudinal axis and a floor guide fixing means for fixing said mounting arm to a floor of a construction, said floor guide fixing means having a fixed guide-to-floor configuration and a released guide-to-floor configuration, said floor guide being slidable along said floor in said released guide-to-floor configuration; and a tool comprising:

a first member fixable to the floor of the construction at a first position along an axial length of the mounting arm;

a tool fixing means for fixing said first member to the floor of the construction at said first position along said axial length of the mounting arm, said tool fixing means having a fixed tool-to-floor configuration and a released tool-to-floor configuration, wherein said floor guide fixing means is in said released guide-to-floor configuration when said tool fixing means is in said fixed tool-to-floor configuration;

a second member fixable to the mounting arm at a second position spaced along said longitudinal axis of the mounting arm from the first member; and a driving means linking the first and second members to one another, wherein space between the first and second members along the longitudinal axis is set by said driving means, wherein said floor guide is slidable along said floor according to said second member and said driving means when said floor guide fixing means is in said released guide-to-floor configuration when said tool fixing means is in said fixed tool-to-floor configuration, wherein the first member comprises a U-shaped bracket having an upper portion spanning a width of said mounting arm and a pair of vertical leg portions extending downward from said upper portion and along sides of said mounting arm so as to form respective lower regions to engage said floor of said construction.

2. The floor guide system as claimed in claim 1, wherein said first member extends at least partially over the mounting arm when fixed to the floor of the construction so as to prevent uplift of the mounting arm from the floor.

3. The floor guide system as claimed in claim 1, wherein said first member straddles the mounting arm so as to prevent both uplift of the mounting arm from the floor and transverse movement of the mounting arm.

4. The floor guide system as claimed in claim 1, wherein said first member is fixable to the floor of the construction on opposed sides of the mounting arm.

5. The floor guide system as claimed in claim 1, wherein said first member comprises an opening, said mounting arm being extendable through said opening, said opening conforming to an outer profile of said mounting arm.

6. The floor guide system as claimed in claim 1, wherein the driving means provides a rigid interconnection between said first member and said second member.

7. The floor guide system as claimed in claim 1, wherein the driving means comprises hydraulic or screw drive means.

8. The floor guide system as claimed in claim 1, wherein the driving means comprises a screw drive, said screw drive being comprised of a threaded drive rod and a floating nut, wherein said floating nut is pivotally mounted.

9. The floor guide system as claimed in claim 1, wherein the driving means is removably attached to said first member so as to allow removable attachment of said driving means from said first member when said first member is fixed to the floor of the construction.

10. The floor guide system as claimed in claim 1, wherein the second member comprises an opening extending perpendicular to said longitudinal axis and being arranged to receive a locking member in locking engagement of said second member to the floor guide.

11. The floor guide system as claimed in claim 10, wherein said locking member is tubular.

12. The floor guide system as claimed in claim 10, wherein said mounting arm of said floor guide comprises a plurality of holes spaced from one another along said axial length of said mounting arm, each hole having an axis perpendicular to said longitudinal axis of said mounting arm, the locking member being received by a respective hole so as to set said locking engagement of said second member to the floor guide.

13. A method of re-positioning a floor guide, said method comprising the steps of:

assembling a floor guide system of claim 1;

fixing the first member to the floor using the tool fixing means;

fixing the second member to the mounting arm;

releasing the floor guide fixing means; and operating the driving means to slide the mounting arm across the floor along its longitudinal axis.

* * * * *